US006604495B2

(12) United States Patent
Moteki

(10) Patent No.: US 6,604,495 B2
(45) Date of Patent: Aug. 12, 2003

(54) VARIABLE COMPRESSION RATIO MECHANISM FOR RECIPROCATING INTERNAL COMBUSTION ENGINE

(75) Inventor: Katsuya Moteki, Tokyo (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/961,240

(22) Filed: Sep. 25, 2001

(65) Prior Publication Data

US 2002/0050252 A1 May 2, 2002

(30) Foreign Application Priority Data

Oct. 31, 2000 (JP) ..... 2000-332254

(51) Int. Cl.[7] ..... F02B 75/04
(52) U.S. Cl. ..... 123/48 B
(58) Field of Search ..... 123/48 B, 78 E, 123/48 R, 78 F, 197.4, 197.3, 192.2, 198 F

(56) References Cited

U.S. PATENT DOCUMENTS

| | | | | |
|---|---|---|---|---|
| 4,485,768 A | * | 12/1984 | Heniges | 123/48 B |
| 4,517,931 A | * | 5/1985 | Nelson | 123/48 B |
| 4,538,557 A | | 9/1985 | Kleiner et al. | |
| 5,595,146 A | | 1/1997 | Bollig et al. | |
| 6,167,851 B1 | * | 1/2001 | Bowling | 123/48 B |
| 6,202,623 B1 | * | 3/2001 | Ehrlich | 123/197.4 |
| 6,260,532 B1 | * | 7/2001 | Mendler | 123/192.2 |

FOREIGN PATENT DOCUMENTS

| | | |
|---|---|---|
| DE | 2508038 | 9/1976 |
| DE | 2734715 | 2/1979 |
| GB | 379169 | 8/1932 |

OTHER PUBLICATIONS

Von Christoph Bollig, et al., "Kurbeltrieb Fur Variable Verdichtung", MTZ Motortechnische Zeitschrift, vol. 58, No. 11, pp. 706–711, (1997).
Pouliot, H.N. –"Designing a Variable–Stroke Engine", Automotive Engineering, vol. 85, No. 6, pp. 50–55, Jun. 1977.

* cited by examiner

*Primary Examiner*—Henry C. Yuen
*Assistant Examiner*—Hyder Ali
(74) *Attorney, Agent, or Firm*—Foley & Lardner

(57) ABSTRACT

A variable compression ratio mechanism for a reciprocating engine includes upper and lower links linking a piston pin to a crankpin, an eccentric cam equipped control shaft and a control link cooperating with each other to vary the attitude of the upper and lower links. A control-shaft actuator is provided to vary a compression ratio. The actuator includes a reciprocating block slider linked at a front end to the control shaft, and a rotary member being in meshed-engagement with the rear end of the slider by a meshing pair of screw-threaded portions. A hydraulic modulator has a hydraulic pressure chamber facing the rear end face of the slider, so that working-fluid pressure in the pressure chamber forces the slider in the same axial direction as the direction of action of reciprocating load acting on the slider owing to combustion load.

18 Claims, 12 Drawing Sheets

FIG.10

| | DURING LOW-TO-HIGH COMPRESSION RATIO CHANGING MODE (DECREASE IN VOLUME IN HYDRAULIC PRESSURE CHAMBER) | DURING HOLD COMPRESSION RATIO MODE (NO CHANGE IN VOLUME IN HYDRAULIC PRESSURE CHAMBER) | DURING HIGH-TO-LOW COMPRESSION RATIO CHANGING MODE (INCREASE IN VOLUME IN HYDRAULIC PRESSURE CHAMBER) |
|---|---|---|---|
| WITH INERTIAL LOAD SUPERIOR TO PISTON COMBUSTION LOAD (DURING HIGH-SPEED, LOW-LOAD OPERATION) | OPEN | CLOSE | CLOSE |
| WITH PISTON COMBUSTION LOAD SUPERIOR TO INERTIAL LOAD (DURING LOW-SPEED, HIGH-LOAD OPERATION) | OPEN | OPEN | OPEN |

VARIABLE COMPRESSION RATIO MECHANISM FOR RECIPROCATING INTERNAL COMBUSTION ENGINE

TECHNICAL FIELD

The present invention relates to the improvements of a variable compression ratio mechanism for a reciprocating internal combustion engine.

BACKGROUND ART

In order to vary a compression ratio between the volume existing within the engine cylinder with the piston at bottom dead center (BDC) and the volume in the cylinder with the piston at top dead center (TDC) depending upon engine operating conditions such as engine speed and load, in recent years, there have been proposed and developed multiple-link type reciprocating piston engines. One such multiple-link type variable compression ratio mechanism has been disclosed in pages 706–711 of the issue for 1997 of the paper "MTZ Motortechnische Zeitschrift 58, No. 11". The multiple-link type variable compression ratio mechanism disclosed in the paper "MTZ Motortechnische Zeitschrift 58, No. 11" is comprised of an upper link mechanically linked at one end to a piston pin, a lower link mechanically linked to both the upper link and a crankpin of an engine crankshaft, a control shaft arranged essentially parallel to the axis of the crankshaft and having an eccentric cam whose axis is eccentric to the axis of the control shaft, and a control link rockably or oscillatingly linked at one end onto the eccentric cam of the control shaft and linked at the other end to the lower end of the upper link. In order to vary the attitude of each of the upper and lower links, the other end of the control link may be linked to the lower link, instead of linking the control link to the upper link. By way of rotary motion of the control shaft, the center of oscillating motion of the control link varies via the eccentric cam, and thus the distance between the piston pin and the crankpin also varies. In this manner, a compression ratio can be varied. In the reciprocating engine with such a multiple-link type variable compression ratio mechanism, the compression ratio is set at a relatively low value at high-load operation to avoid undesired engine knocking from occurring. Conversely, at part-load operation, the compression ratio is set at a relatively high value to enhance the combustion efficiency.

SUMMARY OF THE INVENTION

In order to produce the rotary motion of the control shaft, a control-shaft actuator is used. The control-shaft actuator is often comprised of a control screw portion and a control nut portion engaged with each other. Suppose that an external screw-threaded portion, serving as the control screw portion, is provided on a reciprocating block slider of the actuator, whereas an internal screw-threaded portion, serving as the control nut portion, is provided in a cylindrical member of the actuator. When the cylindrical member is driven in its one rotational direction by means of a power source such as an electric motor or a hydraulic pump, one axial sliding movement of the reciprocating block slider occurs by way of the control screw portion and the control nut portion. Conversely when the cylindrical member is driven in the opposite rotational direction, the opposite axial sliding movement of the reciprocating block slider occurs by way of the control screw portion and the control nut portion. During operation of the reciprocating engine with the multiple-link type variable compression ratio mechanism, owing to a piston combustion load (compression pressure) or inertial load of each of the links, a load acts upon the eccentric cam of the control shaft through the piston pin, the upper link and the control link. That is, owing to the piston combustion load, torque acts to rotate the control shaft in a rotational direction and thus a reciprocating load acts to move the reciprocating block slider in its axial directions. The torque acting on the control shaft will be hereinafter referred to as a "control-shaft torque". The reciprocating load mostly acts in a principal direction, that is, in a direction of the force acting on the reciprocating block slider owing to the piston combustion load. However, at a timing wherein the piston combustion load is less and the inertial load is great, the reciprocating load tends to act in a direction opposite to the principal direction. If the direction of reciprocating load acting on the reciprocating block slider is reversed, there is an increased tendency for the reciprocating block slider to oscillate within a backlash (defined between the internal and external screw-threaded portions) axially relative to the cylindrical member (rotary member) of the actuator. Owing to reversal of the direction of reciprocating load acting on the reciprocating block slider, there is a possibility of collision between the face of tooth of the inner screw-threaded portion and the face of tooth of the external screw-threaded portion, that is, undesired hammering noise and vibration.

Accordingly, it is an object of the invention to provide a variable compression ratio mechanism for a reciprocating internal combustion engine, which avoids or suppresses hammering noise and vibration to occur owing to a backlash defined between internal and external screw-threaded portions being in meshed-engagement with each other and constructing part of a control-shaft actuator.

In order to accomplish the aforementioned and other objects of the present invention, a variable compression ratio mechanism for a reciprocating internal combustion engine including a piston moveable through a stroke in the engine and having a piston pin and a crankshaft changing reciprocating motion of the piston into rotating motion and having a crankpin, the variable compression ratio mechanism comprises a plurality of links mechanically linking the piston pin to the crankpin, a control shaft to which an eccentric cam is attached so that a center of the eccentric cam is eccentric to a center of the control shaft, a control link connected at one end to one of the plurality of links and connected at the other end to the eccentric cam, and an actuator that drives the control shaft within a predetermined controlled angular range and holds the control shaft at a desired angular position so that a compression ratio of the engine continuously reduces by driving the control shaft in a first rotational direction and so that the compression ratio continuously increases by driving the control shaft in a second rotational direction opposite to the first rotational direction, the actuator comprising a reciprocating block slider linked at a first end portion to the control shaft, a rotary member being in meshed-engagement with the second end portion of the slider by a meshing pair of screw-threaded portions, so that rotary motion of the rotary member is converted into axial sliding motion of the slider to drive the control shaft in one of the first and second rotational directions, and a hydraulic pressure chamber facing an axial end face of the second end portion of the slider, so that working-fluid pressure in the hydraulic pressure chamber forces the slider in the same axial direction as a direction of action of a reciprocating load acting on the slider during down stroke of the piston, the reciprocating load acting on the slider in axial directions of the slider during up and down strokes of the piston.

The other objects and features of this invention will become understood from the following description with reference to the accompanying drawings.

BRIEF DESCRIPTION OF THE DRAWINGS

FIG. 10 is a table showing setting of the valve position of the hydraulic pressure regulating valve used to adjust working-fluid pressure in a hydraulic pressure chamber defined in the control-shaft actuator incorporated in the multiple-link type variable compression ratio mechanism of the first embodiment, depending upon engine operating conditions and the operating mode of the engine compression ratio.

DESCRIPTION OF THE PREFERRED EMBODIMENTS

Figure 1:
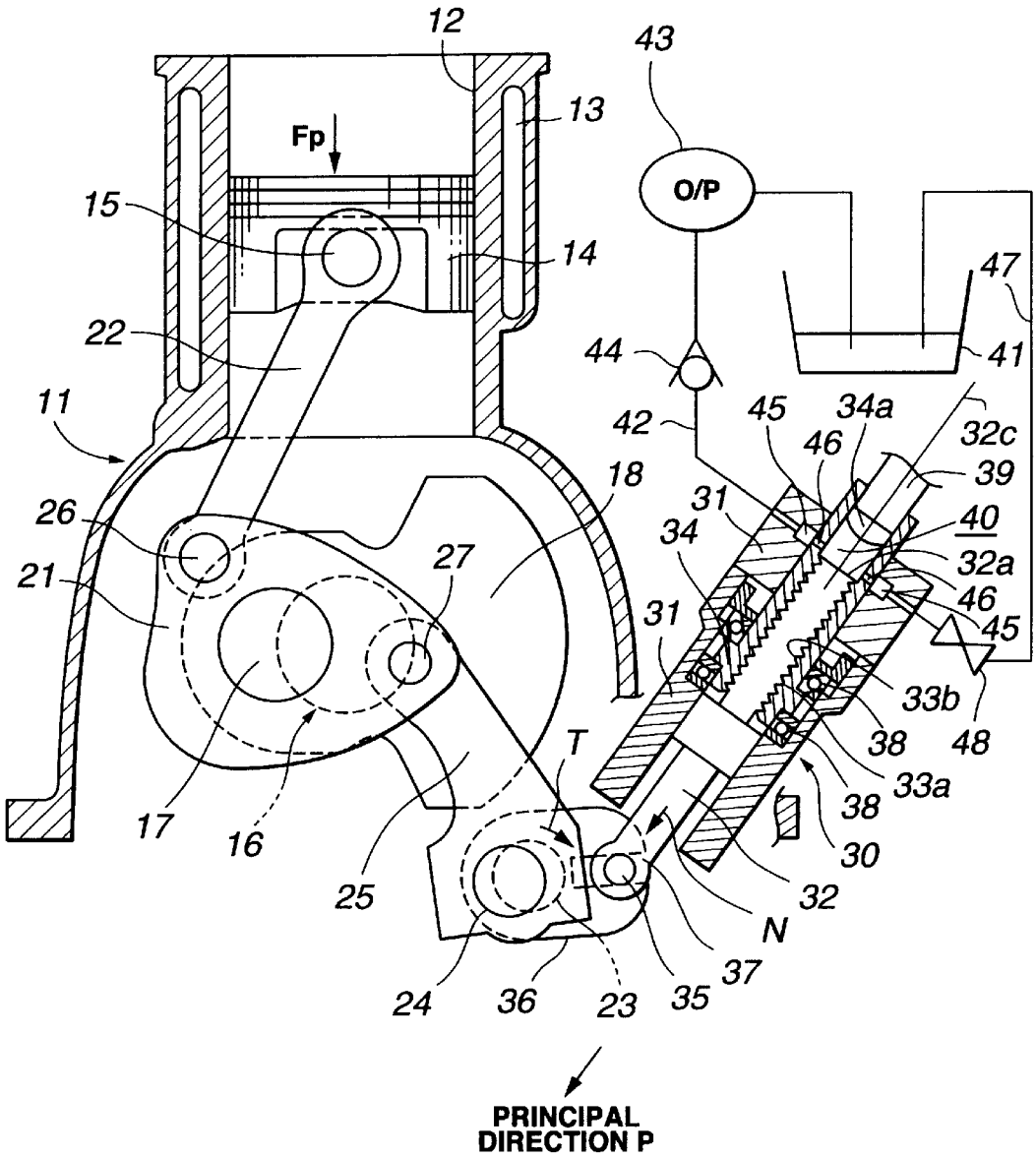
FIG. 1 is an assembled view showing a first embodiment of a multiple-link type variable compression ratio mechanism for a reciprocating engine.
Figure 2:
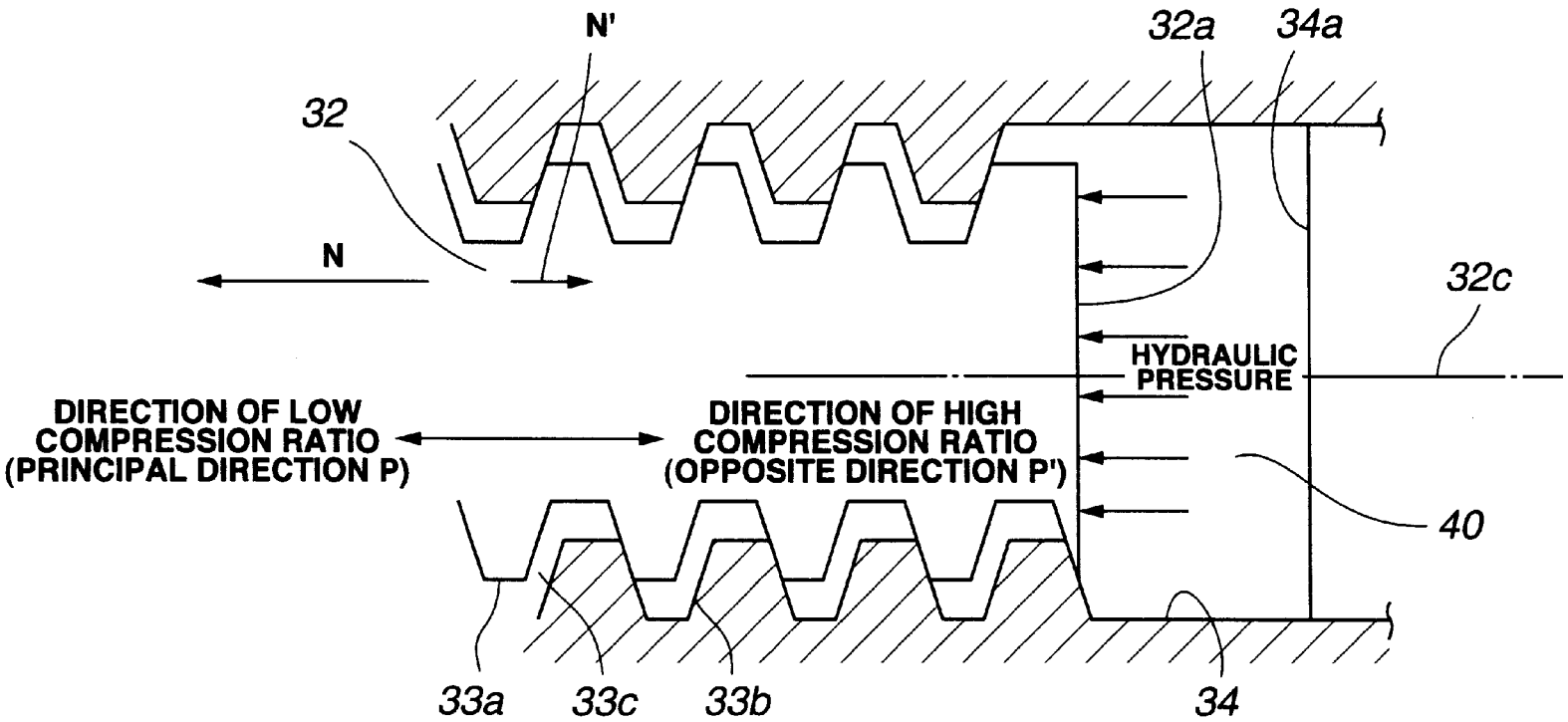
FIG. 2 is an enlarged cross-sectional view illustrating a reciprocating block slider and a rotary member in meshed-engagement and included in a control-shaft actuator.

Referring now to the drawings, particularly to FIG. 1, a cylinder block 11 includes engine cylinders 12, each consisting of a cylindrical design featuring a smoothly finished inner wall that forms a combustion chamber in combination with a piston 14 and a cylinder head (not shown). A water jacket 13 is formed in the cylinder block in such a manner as to surround each engine cylinder. Cylinder 12 serves as a guide for reciprocating motion of piston 14. A piston pin 15 of each of the pistons and a crankpin 17 of an engine crankshaft 16 are mechanically linked to each other by means of a multiple-link type variable compression ratio mechanism (or a multiplelink type piston crank mechanism). In FIG. 1, reference sign 18 denotes a counterweight. The linkage of the multiple-link type variable compression ratio mechanism is comprised of three links, namely a lower link 21, a rod-shaped upper link 22, and a control link 25. Lower link 21 is fitted onto the outer periphery of crankpin 17 in a manner so as to permit relative rotation of lower link 21 to crankpin 17. Upper link 22 is provided to mechanically link the lower link therevia to the piston pin. In order to vary the attitude of each of lower link 21 and upper link 22, the variable compression ratio mechanism of the embodiment also includes a control shaft 23 extending parallel to the axis of crankshaft 16, that is, arranged in a direction parallel to the cylinder row, and an eccentric cam 24 attached to the control shaft so that the center of eccentric cam 24 is eccentric to the center of control shaft 23. Eccentric cam 24 and lower link 21 are mechanically linked to each other through control link 25. A control-shaft actuator 30 (drive means) is provided to rotate or drive control shaft 23 within a predetermined controlled angular range and to hold the control shaft at a desired angular position. The upper end portion of rod-shaped upper link 22 is linked to piston pin 15 in a manner so as to permit relative rotation of upper link 22 to piston pin 15. The lower end portion of rod-shaped upper link 22 is linked or pin-connected to lower link 21 by way of a connecting pin 26, in a manner so as to permit relative rotation of upper link 22 to lower link 21. One end (the upper end) of control link 25 is linked or pin-connected to lower link 21 by way of a connecting pin 27, for relative rotation. The other end (the lower end) of control link 25 is rotatably fitted onto the outer periphery of eccentric cam 24 for relative rotation of control link 25 to eccentric cam 24. Actuator 30 includes a substantially cylindrical actuator casing 31 fixedly connected to cylinder block 11, a reciprocating block slider (or a reciprocating piston) 32 that reciprocates in the actuator casing 31, and a substantially cylindrical rotary member 34 being meshed-engagement with the rear end portion of reciprocating block slider 32 by means of a meshing pair of screw-threaded portions (33*a*, 33*b*). In more detail, as shown in FIG. 2, an external screw-threaded portion 33*a* is formed on the outer periphery of the substantially rod-like, rear end portion of reciprocating block slider 32, whereas an internal screw-threaded portion 33*b* is formed on the inner periphery of substantially cylindrical rotary member 34, so that the internal and external screw-threaded portions 33*b* and 33*a* are in meshed-engagement with each other. In order to allow a dimensional tolerance, there is a predetermined backlash 33*c* (i.e., a predetermined axial clearance) between the face of tooth of external screw-threaded portion 33*a* and the face of tooth of internal screw-threaded portion 33*b*. Referring again to FIG. 1, reciprocating block slider 32 is arranged in a direction normal to the axis of control shaft 23 in such a manner as to reciprocate in the actuator casing 31 in the axial direction of reciprocating block slider 32. A pin 35 is attached to the tip end portion (the front end portion) of reciprocating block slider 32 so that the axis of pin 35 is arranged in a direction perpendicular to the axial direction of reciprocating block slider 32. On the other hand, a control plate 36 is attached to one end of control shaft 23 and has a radially extending slit 37. Pin 35 of reciprocating block slider 32 is slidably fitted into slit 37 of control plate 36. Rotary member 34 is rotatably supported in actuator casing 31 by means of bearings 38 in a manner so as to rotate about its axis. An output shaft 39 of a power source such as an electric motor is fixedly connected to one end of rotary member 34. In the shown embodiment, the electric motor is used as a power source. In lieu thereof, a hydraulic pump may be used as a power source. In response to a control signal from an electronic engine control unit often abbreviated to "ECU" (not shown), rotary member 34 can be rotated or driven about its axis via the output shaft 34 of the power source. The control signal value of the ECU is dependent upon engine operating conditions such as engine speed and load. A hydraulic pressure chamber 40 is formed in actuator casing 31 of actuator 30 so that hydraulic pressure chamber 40 faces the rear axial end face 32*a* of reciprocating block slider 32. Concretely, hydraulic pressure chamber 40 is defined by the inner peripheral wall surface of rotary member 34, the rear axial end face 32*a* of reciprocating block slider 32, and a cap portion 34*a* attached to the connecting end of output shaft 39 fixedly connected to rotary member 34. Cap portion 34*a* serves to plug up the opening end of substantially cylindrical rotary member 34 in a fluid-tight fashion. As seen in FIG. 1, a hydraulic modulator is provided to control or regulate the hydraulic pressure in hydraulic pressure chamber 40. The hydraulic modulator is comprised of a working-fluid supply passage 42, an oil pump 43 serving as a hydraulic pressure source, and a one-way check valve 44. Supply passage 42 is provided to supply working fluid reserved in an oil pan 41 into hydraulic pressure chamber 40. Check valve 44 is fluidly disposed between oil pump 43 and hydraulic pressure chamber 40 so as to check or prevent back flow of working fluid from hydraulic pressure chamber 40 toward oil pump 43. Supply passage 42 includes a substantially annular circumferential groove 45 formed or recessed in the inner periphery of substantially cylindrical actuator casing 31, and a first one of a pair of radial through holes (46, 46) formed in substantially cylindrical rotary member 34 in such a manner that circumferential groove 45 is communicated with hydraulic pressure chamber 40 through the first radial through hole 46. The hydraulic modulator also includes a working-fluid drain passage 47 and a hydraulic pressure regulating valve 48. Drain passage 47 is provided to drain the working fluid from hydraulic pressure chamber 40 into oil pan 41. Hydraulic pressure regulating valve 48 is fluidly disposed in drain passage 47 to regulate or adjust the hydraulic pressure in hydraulic pressure chamber 40 or the hydraulic pressure in drain passage 47. Hydraulic pressure regulating valve 48 also serves as a pressure relief valve that opens when a predetermined pressure is reached, to prevent the hydraulic pressure in hydraulic pressure chamber 40 from excessively developing. Drain passage 47 includes both the previously-noted circumferential groove 45 and the second radial through hole 46.

With the previously-noted arrangement, when rotary member 34 is driven in its one rotational direction in response to a control signal from the ECU, one axial sliding movement of reciprocating block slider 32, threadably engaged with rotary member 34, occurs. Conversely, when rotary member 34 is driven in the opposite rotational direction in response to a control signal from the ECU, the opposite axial sliding movement of reciprocating block slider 32 occurs. In this manner, reciprocating block slider 32 can move relative to rotary member 34 in its axial direction (see the axis 32*c* of FIG. 1), and thus control shaft 23 can be rotated in a desired rotational direction based on the control signal from the ECU, with sliding movement of pin 35 within slit 37. As may be appreciated, actuator 30 is designed or constructed so that undesirable reciprocating motion of the reciprocating block slider is prevented by way of meshed-engagement between internal screw-threaded portion 33*b* of rotary member 34 and external screw-threaded portion 33*a* of reciprocating block slider 32, and so that rotary motion of rotary member 34 is converted into reciprocating motion of reciprocating block slider 32. That is, the power-transmission mechanism of actuator 30 is constructed as an irreversible power-transmission mechanism containing the meshing pair of screw-threaded portions (33*a*, 33*b*) disposed between rotary member 34 and reciprocating block slider 32. In this manner, the center of oscillating motion of control link 25 fitted onto eccentric cam 24 can be varied by rotating control shaft 23 depending on engine operating conditions. As a result of this, the attitude of each of upper and lower links 22 and 21 also varies. A compression ratio of the combustion chamber, that is, a compression ratio between the volume existing within the cylinder with the piston at BDC and the volume in the cylinder with the piston at TDC can be variably controlled depending upon engine operating conditions. In the variable compression ratio mechanism of the embodiment, piston pin 15 and crankshaft 16 are mechanically linked by means of only two links, namely upper and lower links 22 and 21. Therefore, the variable compression ratio mechanism of the embodiment is simple in construction, as compared to a multiple-link type variable compression ratio mechanism comprised of three or more links. Additionally, control link 25 is connected to lower link 21, but not connected to upper link 22. Thus, control link 25 and control shaft 23 can be laid out within a comparatively wide space defined in the lower portion of the engine. Thus, it is possible to easily mount the variable compression ratio mechanism of the embodiment in the engine.

Figure 3:
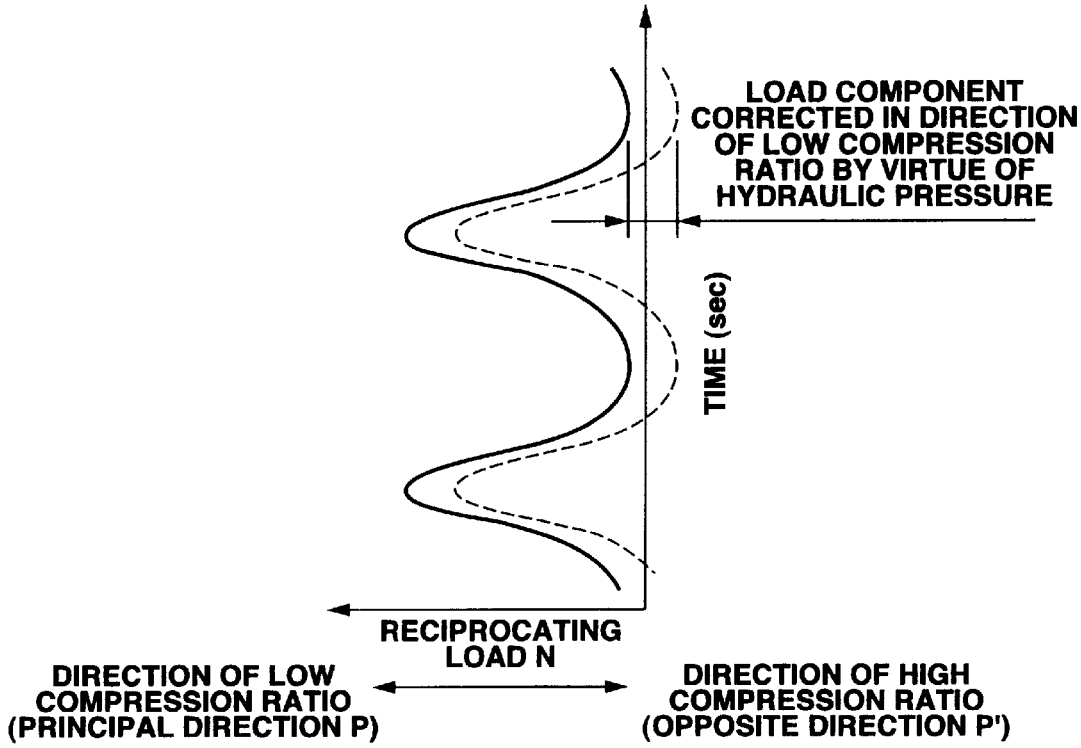
FIG. 3 is a characteristic curve illustrating a time change in reciprocating load N in two difference cases, namely in presence of hydraulic pressure acting on an axial end face of the reciprocating block slider, and in absence of hydraulic pressure acting on the axial end face of the reciprocating block slider.

During operation of the engine, owing to the piston combustion load Fp pushing the piston crown of piston 14 downwards or owing to inertial load of each of links, input load acts upon eccentric cam 24 of control shaft 23 through piston pin 15, upper link 22, connecting pin 26, lower link 21, connecting pin 27 and control link 25, and as a result input torque (control-shaft torque) T acts to rotate control shaft 23 in a rotational direction and thus a reciprocating load (N, N') acts to move the reciprocating block slider in axial directions of reciprocating block slider 32 during up and down strokes of the piston. Reciprocating load N mostly acts in a principal direction, that is, in a direction P of the force acting on the reciprocating block slider during down stroke of the piston owing to piston combustion load Fp (see the direction P indicated in FIG. 2). However, at a timing wherein piston combustion load Fp is less and inertial load is great, as appreciated from the waveform of reciprocating load N indicated by the broken line in FIG. 3, there is a possibility that the reciprocating load acts in a direction opposite to the principal direction P (see the opposite direction P' in FIG. 3). As indicated by the broken line in FIG. 3, if the direction of the reciprocating load acting on reciprocating block slider 32 is reversed, there is an increased tendency for reciprocating block slider 32 to oscillate or move axially relative to rotary member 34 within the predetermined backlash 33*c*. Due to reversal of the direction of the reciprocating load acting on reciprocating block slider 32, there is a possibility of collision between the face of tooth of inner screw-threaded portion 33*b* of rotary member 34 and the face of tooth of external screw-threaded portion 33*a* of reciprocating block slider 32, that is, undesired hammering noise and vibration. To avoid this, the variable compression ratio mechanism of the embodiment is constructed so that reciprocating block slider 32 is biased in the same direction as the principal direction P of the reciprocating load by virtue of the working-fluid pressure in hydraulic pressure chamber 40. That is, hydraulic pressure chamber 40 is constructed to face the previously-noted reciprocating-block-slider rear axial end face 32*a* facing in the opposite direction P' (see FIG. 2), so that the hydraulic pressure in hydraulic pressure chamber 40 is applied onto reciprocating-block-slider rear axial end face 32*a*. In the shown embodiment, when reciprocating block slider 32 moves in the principal direction P, control shaft 23 rotates in the direction of the low compression ratio. In contrast to the above, when reciprocating block slider 32 moves in the opposite direction P', control shaft 23 rotates in the direction of the high compression ratio. That is to say, pressure chamber 40 faces to reciprocating-block-slider rear axial end face 32*a* facing in the direction P' of the high compression ratio, so that the hydraulic pressure constantly acts on reciprocating-block-slider rear axial end face 32*a* during operation of the engine. In other words, during operation of the engine, reciprocating block slider 32 is pre-loaded in the principal direction P by constantly acting the hydraulic pressure in pressure chamber 40 on reciprocating-block-slider rear axial end face 32*a*. As a result of this, as appreciated from the waveform of reciprocating load N indicated by the solid line in FIG. 3, the direction of reciprocating load N is always maintained in the principal direction P. That is, in the presence of application of hydraulic pressure properly regulated and acting on reciprocating-block-slider rear axial end face 32*a*, there is no risk of reversing the direction of the reciprocating load owing to the piston combustion load Fp and inertial load of each of links. That is, the hydraulic pressure in hydraulic pressure chamber 40 is set or regulated to a predetermined pressure level (or a set pressure value) that reversal of the direction of reciprocating load N never occurs. During application of the hydraulic pressure regulated to the predetermined pressure level, as shown in FIG. 2, the face of tooth of reciprocating-block-slider external screw-threaded portion 33*a* facing in the principal direction P is constantly pressed against the face of tooth of rotary-member internal screw-threaded portion 33*b* facing in the opposite direction P'. This effectively avoids undesired collision between the face of tooth of inner screw-threaded portion 33*b* and the face of tooth of external screw-threaded portion 33*a* and effectively prevents undesired hammering noise and vibration which may occur owing to predetermined backlash 33*c*. In addition to the above, a portion of working fluid in hydraulic pressure chamber 40 can be fed into the tooth space between the meshing pair of screw-threaded portions (33*a*, 33*b*), for good lubrication of the face of tooth and enhanced durability. Furthermore, the hydraulic modulator has the check valve 44 fluidly disposed in supply passage 42 and between oil pump 43 and hydraulic pressure chamber 40. By the use of check valve 44, it is possible to certainly prevent counter-flow of working fluid in hydraulic pressure chamber 40 back to oil pump 43.

Figure 4:
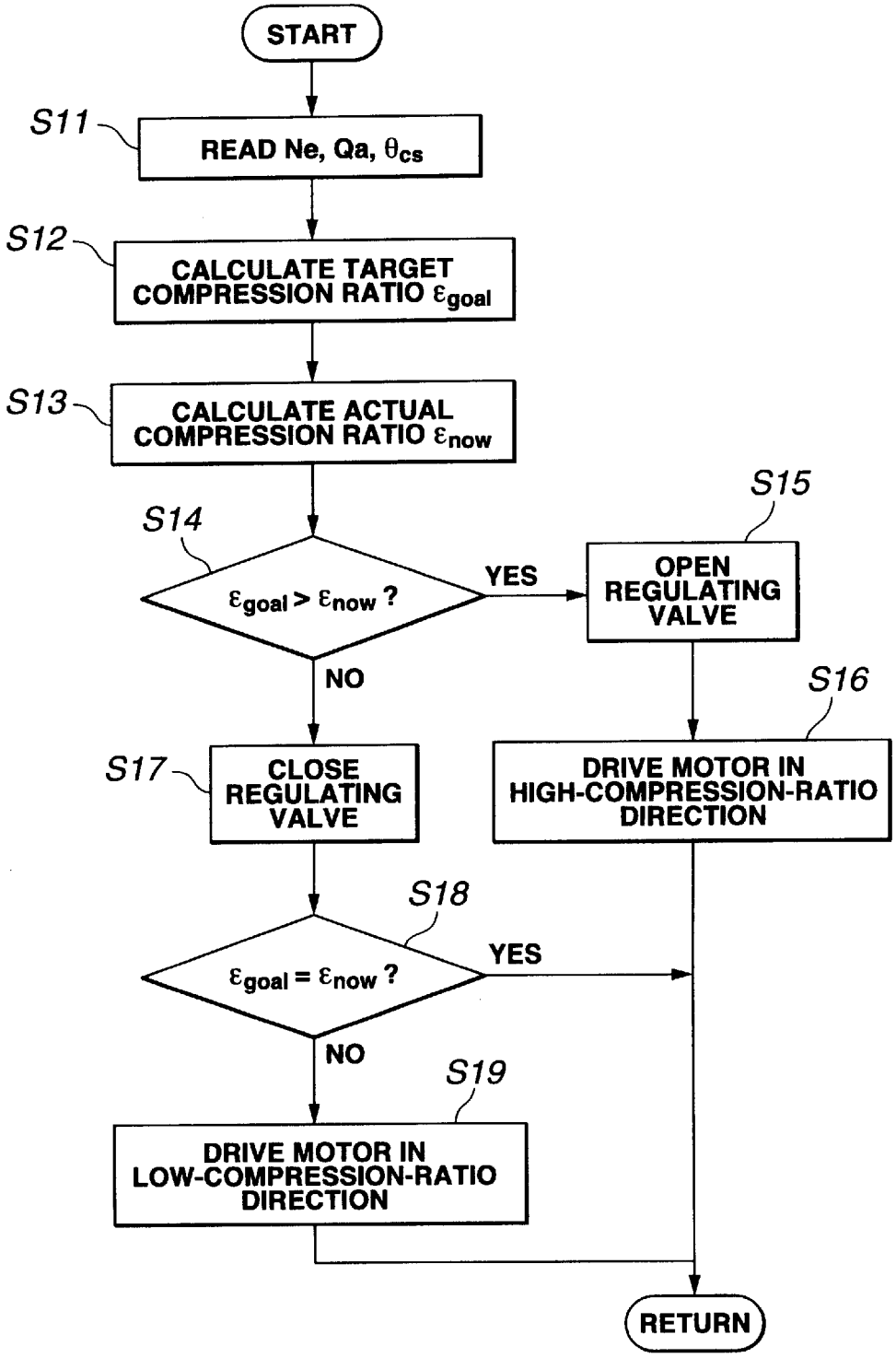
FIG. 4 is a flow chart illustrating a control routine used to control the opening and closing of a hydraulic pressure regulating valve and the operation of the control-shaft actuator incorporated in the multiplelink type variable compression ratio mechanism of the first embodiment.
Figure 5:
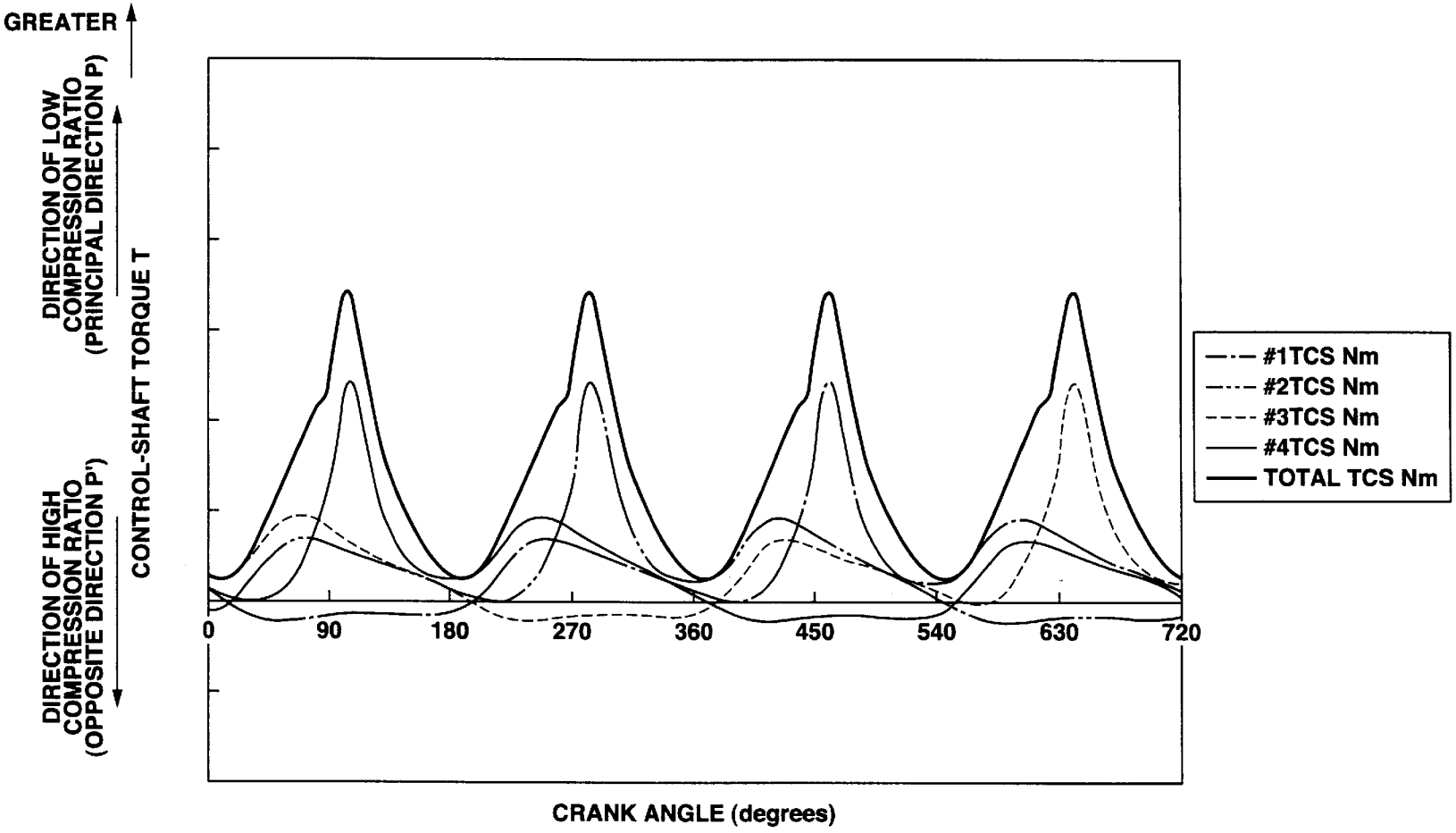
FIG. 5 is a graph showing the relationship between a crank angle and a control-shaft torque T at an engine speed of 3000 rpm.
Figure 6:
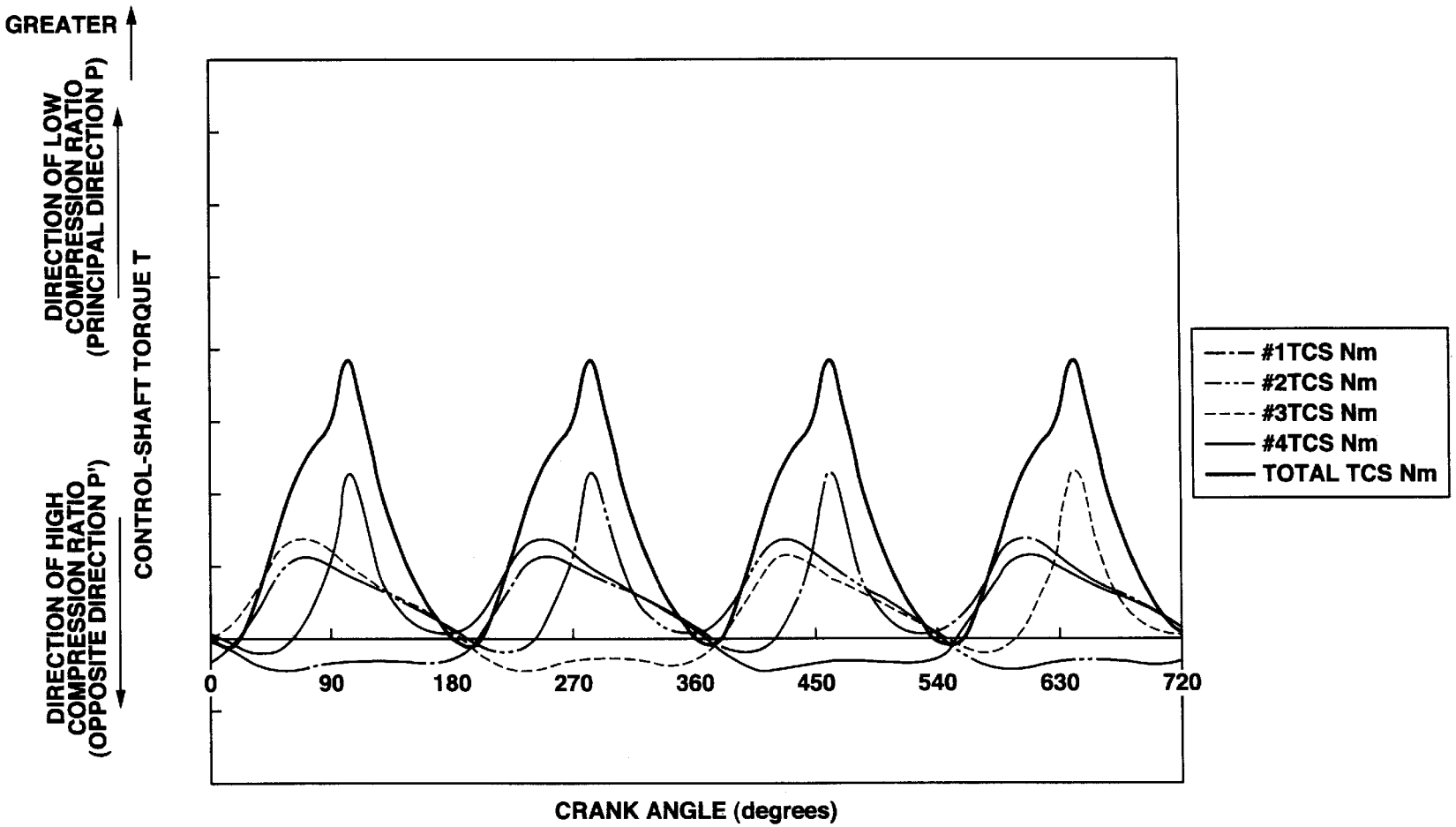
FIG. 6 is a graph showing the relationship between a crank angle and a control-shaft torque T at engine speed of 4000 rpm.
Figure 7:
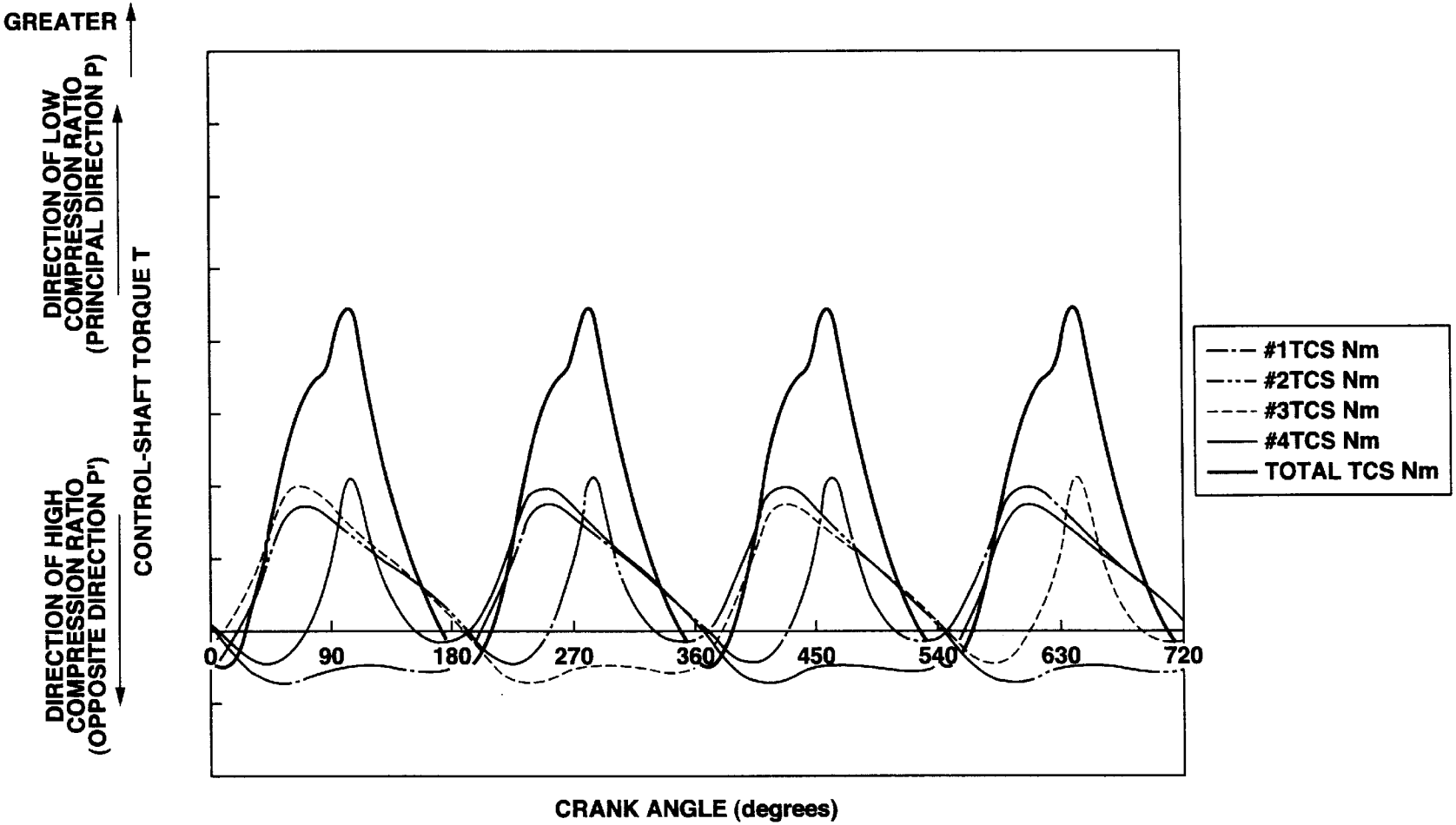
FIG. 7 is a graph showing the relationship between a crank angle and a control-shaft torque T at engine speed of 5000 rpm.
Figure 8:
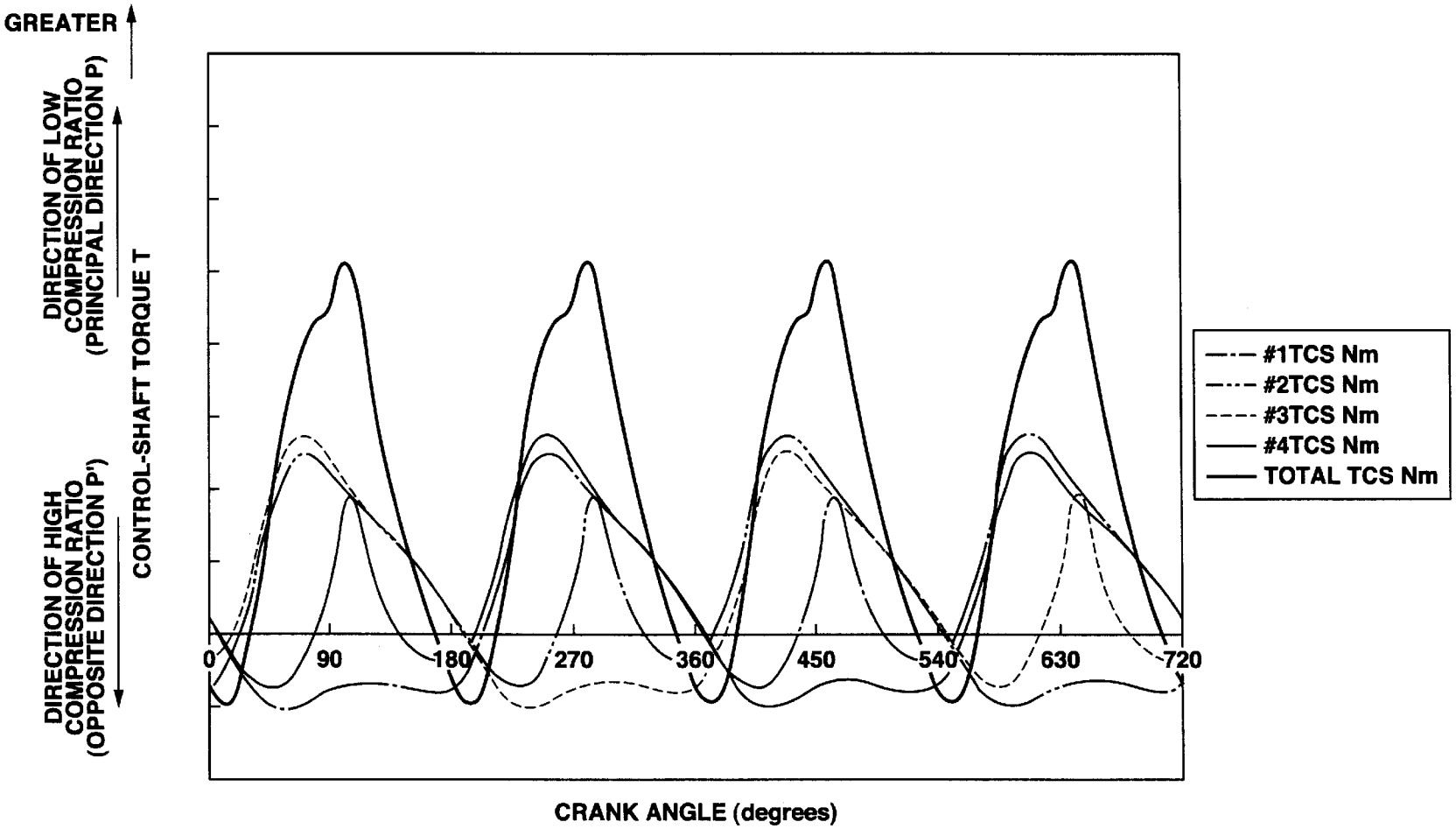
FIG. 8 is a graph showing the relationship between a crank angle and a control-shaft torque T at engine speed of 6000 rpm.

Referring now to FIG. 4, there is shown the control routine needed to control the opening and closing of hydraulic pressure regulating valve 48 and the operation of the power source (electric motor) for control-shaft actuator 30. The routine shown in FIG. 4 is executed as time-triggered interrupt routines to be triggered every predetermined time intervals.

At step S11, engine speed Ne, an intake-air quantity Qa, and a phase angle $\theta_{cs}$ of control shaft 23 are read.

At step S12, a target compression ratio $\epsilon_{goal}$ is arithmetically calculated based on both engine speed Ne and intake-air quantity Qa.

At step S13, an actual compression ratio $\epsilon_{now}$ is arithmetically calculated based on phase angle $\theta_{cs}$ of control shaft 23.

At step S14, a check is made to determine whether target compression ratio $\epsilon_{goal}$ is greater than actual compression ratio $\epsilon_{now}$. When the answer to step S14 is in the affirmative ($\epsilon_{goal}>\epsilon_{now}$), that is, when shifting of the reciprocating block slider to the direction of the high compression ratio is required (in other words, when a decrease in the volume in hydraulic pressure chamber 40 is required), the routine proceeds from step S14 to step S15. At step S15, hydraulic pressure regulating valve 48 is opened, and as a result a part of the working fluid in hydraulic pressure chamber 40 is properly exhausted into oil pan 41, thus avoiding an excessive rise in hydraulic pressure in pressure chamber 40. Thereafter, the routine flows from step S15 to step S16. At step S16, output shaft 39 of the power source (motor) is rotated or driven in the high-compression-ratio rotational direction. Conversely, when the answer to step S14 is in the negative ($\epsilon_{goal}\leqq\epsilon_{now}$), that is, when shifting of the reciprocating block slider to the direction of the low compression ratio is required (in other words, when an increase in the volume in hydraulic pressure chamber 40 is required), the routine proceeds from step S14 to step S17. At step S17, hydraulic pressure regulating valve 48 is closed, and as a result the working fluid in hydraulic pressure chamber 40 is not exhausted via drain passage 47 into oil pan 41, but properly charged or stored in hydraulic pressure chamber 40. In the same manner as shifting of reciprocating block slider 32 to the direction of the low compression ratio, when the reciprocating block slider has to be maintained at the current axial position, that is, when the volume in hydraulic pressure chamber 40 has to be held constant, the routine proceeds from step S14 to step S17, and therefore hydraulic pressure regulating valve 48 is closed. As a result, the working fluid in hydraulic pressure chamber 40 is not exhausted via drain passage 47 into oil pan 41, and thus a pressure drop in the hydraulic pressure in pressure chamber 40 is suppressed. After step S17, step S18 occurs. At step S18, a check is made to determine whether target compression ratio $\epsilon_{goal}$ is equal to actual compression ratio $\epsilon_{now}$. When the answer to step S18 is in the affirmative ($\epsilon_{goal}=\epsilon_{now}$), one cycle of the control routine terminates. Conversely when the answer to step S18 is in the negative ($\epsilon_{goal}\neq\epsilon_{now}$), the routine proceeds from step S18 to step S19. At step S19, output shaft 39 of the power source (motor) is rotated or driven in the low-compression-ratio rotational direction. The predetermined pressure level of the hydraulic pressure in pressure chamber 40 is determined depending on the discharge pressure of working fluid discharged from oil pump 43. For the purpose of certainly preventing undesired oscillation of reciprocating block slider 32 owing to predetermined backlash 33*c*, the set pressure value of working fluid in hydraulic pressure chamber 40 may be set to a pressure value higher than the discharge pressure of oil pump 43. In this case, the set pressure value higher than the discharge pressure of oil pump 43 can be obtained by shifting the reciprocating block slider to the high-compression-ratio direction under a condition wherein hydraulic pressure regulating valve is closed and thus the working fluid in sealed up in pressure chamber 40.

Figure 9:
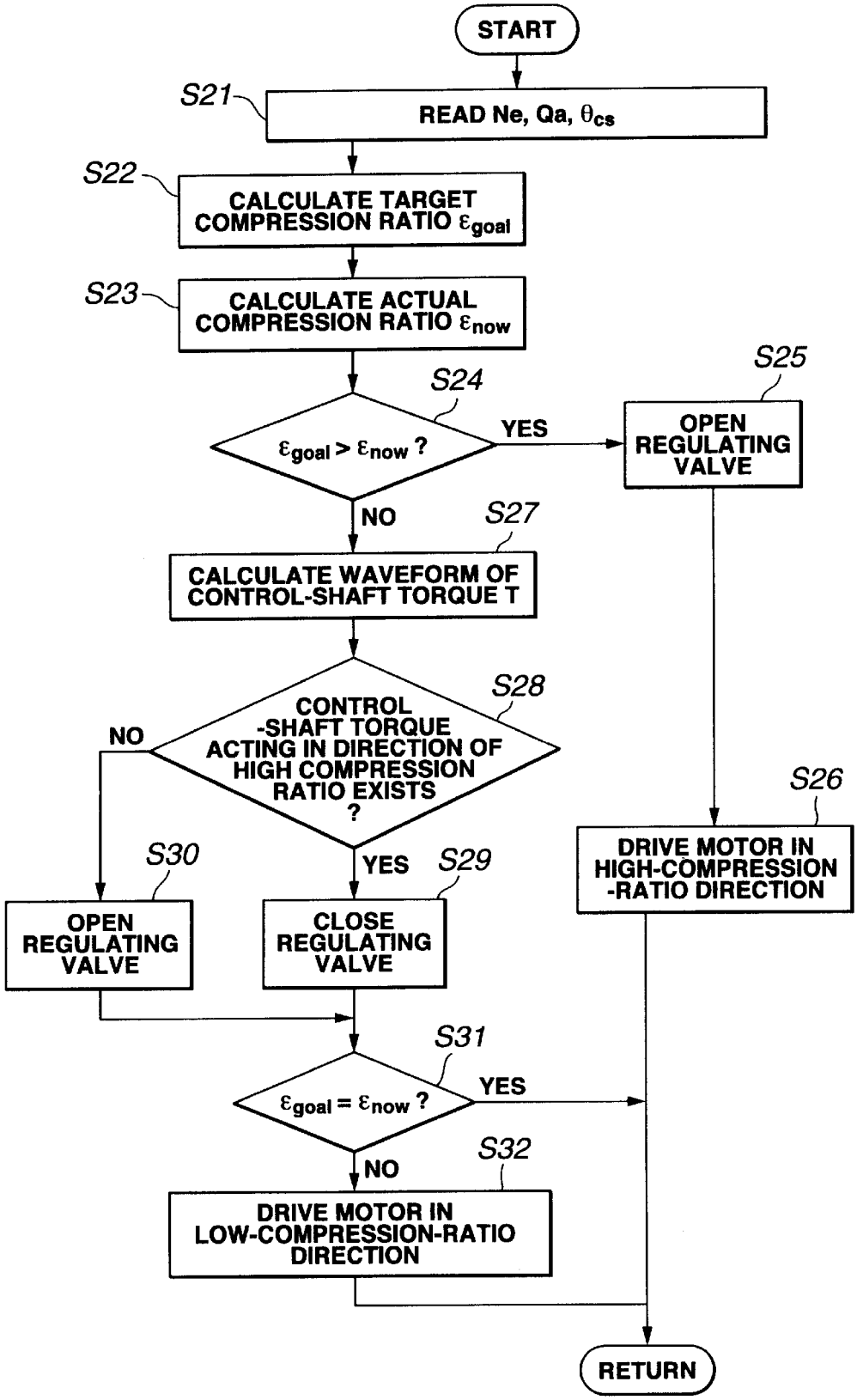
FIG. 9 is a flow chart illustrating another control routine used to control both the opening and closing of a hydraulic pressure regulating valve and the operation of the control-shaft actuator incorporated in the multiple-link type variable compression ratio mechanism of the first embodiment.

Referring now to FIGS. 5 through 8, there are shown waveforms of control-shaft torque T in a four-cylinder engine. A particular condition in which control-shaft torque T acting on control shaft 23 is reversed (that is, the direction of reciprocating load N acting on reciprocating block slider 32 is reversed), in other words, the torque value of input torque acting on control shaft 23 is changed from positive to negative, is hereunder described in detail in reference to FIGS. 5–8. In FIGS. 5–8, the x-axis (abscissa) indicates a crank angle (unit: degrees), the y-axis (ordinate) indicates control-shaft torque T acting on control shaft 23, #1TCS indicates the control-shaft torque occurring in No. 1 cylinder, #2TCS indicates the control-shaft torque occurring in No. 2 cylinder, #3TCS indicates the control-shaft torque occurring in No. 3 cylinder, #4TCS indicates the control-shaft torque occurring in No. 4 cylinder, and TOTAL TCS indicates the total controlshaft torque. The angular position of crankshaft 16 corresponding to 0° crankangle is defined as a specified state wherein the axis of crankpin 17 is aligned with the axis of crankshaft 16 in the major thrust direction or in the minor thrust direction. The direction of action of control-shaft torque T created when the downward piston combustion load Fp acts on the piston crown of piston 14, that is, the clockwise direction (see the direction of action of torque T shown in FIG. 1) is defined as a positive direction. In contrast, the counterclockwise direction is defined as a negative direction. That is to say, when control-shaft torque T is positive and thus the direction of action of control-shaft torque T is the positive direction, the reciprocating load acts on reciprocating block slider 32 in the principal direction P. Conversely when control-shaft torque T is negative and thus the direction of action of control-shaft torque T is the negative direction, the reciprocating load acts on reciprocating block slider 32 in the opposite direction P'. As seen in FIG. 2, the reciprocating load acting on reciprocating block slider 32 in the principal direction P is denoted by "N", while the reciprocating load acting on reciprocating block slider 32 in the opposite direction P' is denoted by "N'". FIGS. 5, 6, 7 and 8 show respective simulation results obtained at four different engine speeds, namely 3000 rpm, 4000 rpm, 5000 rpm, 6000 rpm. In case of the four-cylinder engine, the control-shaft torque becomes maximum every 90° crankangle at which the piston of each cylinder passes through TDC. On the contrary, the control-shaft torque becomes minimum at every crankangle being offset from the crankangle corresponding to the maximum control-shaft torque by approximately 45 degrees. The decrease in control-shaft torque T mainly arises from the increase in inertial load acting on the piston in the direction opposite to the direction of action of piston combustion load Fp. The inertial load tends to increase, as the engine speed increases. For the reasons set forth above, as can be appreciated from the waveform of total control-shaft torque TOTAL TCS shown in FIG. 5, in a predetermined engine speed range less than or equal to a predetermined low engine speed a such as 3000 rpm, the minimum torque value of the total control-shaft torque is a positive value. In other words, in the predetermined engine speed range, the direction of action of control-shaft torque T is the positive direction, that is, the low-compression-ratio direction, and thus there is no risk of reversing the direction of action of control-shaft torque T (i.e., the direction of reciprocating load N). The previously-noted predetermined low engine speed $\alpha$ below which reversal of the direction of reciprocating load N (i.e., reversal of the direction of action of control-shaft torque T) never occurs, varies depending on both the engine load and phase angle $\theta_{cs}$ of control shaft 23. Thus, it is preferable to variably set the predetermined low engine speed $\alpha$, taking into account both the engine load and phase angle $\theta_{cs}$ of control shaft 23. During operation of the engine in the predetermined engine speed range less than or equal to predetermined low engine speed $\alpha$, there is no risk of reversing the direction of action of control-shaft torque T (i.e., the direction of reciprocating load N), and therefore hydraulic pressure regulating valve 48 is opened to reduce the working-fluid pressure in hydraulic pressure chamber 40. As a result of this, a load of oil pump 43 can be reduced, and thus the engine efficiency can be enhanced. In contrast to the above, during operation of the engine in an engine speed range above the predetermined low engine speed a, as can be appreciated from the waveforms of total control-shaft torque TOTAL TCS shown in FIGS. 6–8, in an engine speed range above predetermined low engine speed a such as 3000 rpm, the minimum torque value of the total control-shaft torque is a negative value. That is, in the engine speed range above predetermined low engine speed $\alpha$, there is a risk of reversing the direction of action of control-shaft torque T (i.e., the direction of reciprocating load N). In more detail, the absolute value of the negative minimum torque value of total control-shaft torque TOTAL TCS tends to increase, as the engine speed increases from 4000 rpm (see FIG. 6) via 5000 rpm (see FIG. 7) to 6000 rpm (see FIG. 8). In such a case, hydraulic pressure regulating valve 48 is closed, so as to produce a relatively high hydraulic pressure enough to avoid undesirable reversal of the direction of reciprocating load N (i.e., undesirable reversal of the direction of action of control-shaft torque T). FIG. 9 shows the modified control routine needed to control the opening and closing of hydraulic pressure regulating valve 48 and the operation of the power source (electric motor) for control-shaft actuator 30, taking account of whether the engine is operating in or out of the predetermined engine speed range above predetermined low engine speed $\alpha$.

The modified control routine of FIG. 9 is similar to the routine of FIG. 4, except that step S17 included in the routine shown in FIG. 4 is replaced with steps S27, S28, S29 and S30 included in the modified routine shown in FIG. 9. Thus, the same step numbers used to designate steps in the routine shown in FIG. 4 will be applied to the corresponding step numbers used in the modified routine shown in FIG. 9, for the purpose of comparison of the two different routines. Steps S21, S22, S23, S24, S25, S26, S31, and S32 shown in FIG. 9 correspond to the respective steps S11, S12, S13, S14, S15, S16, S18, and S19 shown in FIG. 4. Steps S27, S28, S29 and S30 will be hereinafter described in detail with reference to the accompanying drawings, while detailed description of steps S21 through S26, S31 and S32 will be omitted because the above description thereon seems to be self-explanatory.

When the answer to step S24 is affirmative ($\epsilon_{goal}>\epsilon_{now}$), that is, when shifting of the reciprocating block slider to the direction of the high compression ratio is required (in other words, when a decrease in the volume in hydraulic pressure chamber 40 is required), the routine proceeds from step S24 to step S25, so as to open hydraulic pressure regulating valve 48. As a result, a part of the working fluid in hydraulic pressure chamber 40 is properly exhausted into oil pan 41, thus avoiding an excessive rise in hydraulic pressure in pressure chamber 40. Thereafter, at step S26, output shaft 39 of the power source (motor) is rotated or driven in the high-compression-ratio rotational direction.

Conversely when the answer to step S24 is negative ($\epsilon_{goal}\leqq\epsilon_{now}$), that is, when shifting of the reciprocating block slider to the direction of the low compression ratio is required (in other words, when an increase in the volume in hydraulic pressure chamber 40 is required), or when the reciprocating block slider has to be maintained at the current axial position, that is, when the volume in hydraulic pressure chamber 40 has to be held constant, the routine proceeds from step S24 to step S27. At step S27, the waveform of control-shaft torque T is calculated or estimated on the basis of engine operating conditions, in particular engine speed Ne (see FIGS. 5 through 8). Thereafter, at step S28, a check is made to determine whether control-shaft torque T acting in the opposite direction P' (in the direction of the high compression ratio) exists, that is, whether the direction of action of control-shaft torque T is reversed. In other words, at step S28, a check is made to determine whether the engine is operating in the engine speed range above predetermined low engine speed a for example 3000 rpm. When the answer to step S28 is affirmative, that is, when step S28 determines that the direction of action of control-shaft torque T is reversed, the routine proceeds from step S28 to step S29. At step S29, hydraulic pressure regulating valve 48 is closed, and as a result the working fluid in hydraulic pressure chamber 40 is not exhausted via drain passage 47 into oil pan 41, thus effectively preventing or suppressing a drop in working-fluid pressure in hydraulic pressure chamber 40. As a consequence, it is possible to effectively prevent reversal of the direction of action of control-shaft torque T by virtue of the relatively high working-fluid pressure in hydraulic pressure chamber 40. In contrast to the above, when the answer to step S28 is negative, that is, when step S28 determines that the direction of action of control-shaft torque T is not reversed, the routine proceeds from step S28 to step S30. At step S30, hydraulic pressure regulating valve 48 is opened, and as a result an undesirable pressure rise in the working fluid in hydraulic pressure chamber 40 is avoided. After steps S29 or S30, step S31 occurs. When the answer to step S31 is in the affirmative ($\epsilon_{goal}=\epsilon_{now}$), one cycle of the control routine terminates. Conversely when the answer to step S31 is in the negative ($\epsilon_{goal}\neq\epsilon_{now}$), the routine proceeds from step S31 to step S32, so as to drive the output shaft of the power source (motor) in the low-compression-ratio rotational direction. As discussed above in reference to FIG. 9, when the ECU determines that control-shaft torque T acting in the opposite direction P' does not exist and thus the direction of action of control-shaft torque T is not reversed, for example during low-speed, high-load operation, hydraulic pressure regulating valve 48 is opened irrespective of whether the variable compression ratio mechanism is operated in a low-to-high compression ratio changing mode wherein the engine compression ratio is changed from low to high, in a high-to-low compression ratio changing mode wherein the engine compression ratio is changed from high to low, or in a hold compression ratio mode wherein the engine compression ratio is held constant (see FIG. 10). Conversely when the ECU determines that control-shaft torque T acting in the opposite direction P' exists and thus the direction of action of control-shaft torque T is reversed, for example during high-speed, low-load operation, hydraulic pressure regulating valve 48 is closed when the variable compression ratio mechanism is operated in the high-to-low compression ratio changing mode or in the hold compression ratio mode, but opened when the variable compression ratio mechanism is operated in the low-to-high compression ratio changing mode (see FIG. 10). As set forth above, according to the variable compression ratio mechanism of the embodiment, it is possible to effectively prevent reversal of the direction of action of control-shaft torque T depending on the engine speed Ne, by properly rising the working-fluid pressure in hydraulic pressure chamber 40 in accordance with an increase in the engine speed. It is advantageous to use oil pump 43 constructed as a mechanical oil pump which is mechanically linked to engine crankshaft 16 so that the oil pump is driven by way of rotation of crankshaft 16, since a driving force of oil pump 43 increases as the engine speed increases and therefore the working-fluid pressure in hydraulic pressure chamber 40 also rises in accordance with the increase in the engine speed.

Figure 11:
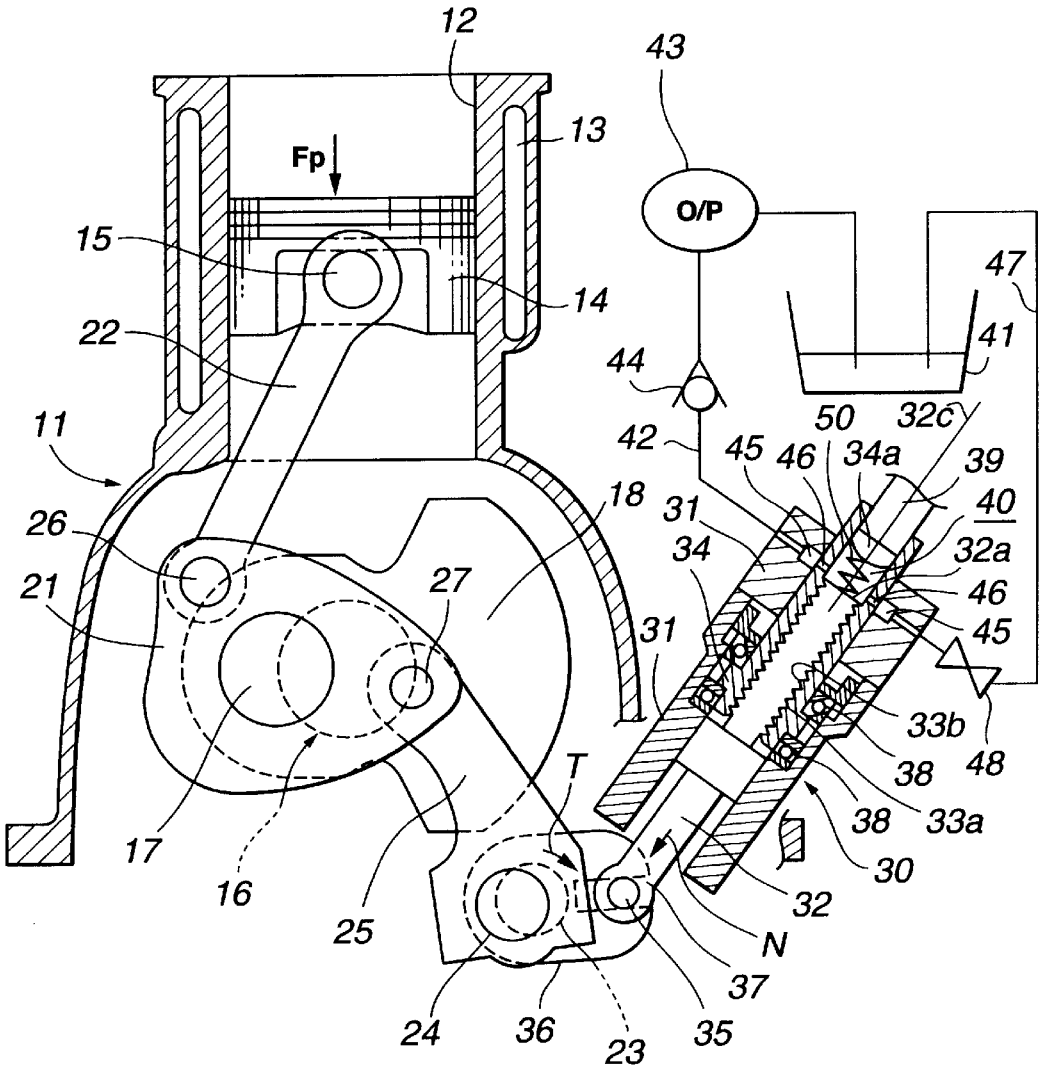
FIG. 11 is an assembled view showing a second embodiment of a multiple-link type variable compression ratio mechanism for a reciprocating engine.
Figure 12:
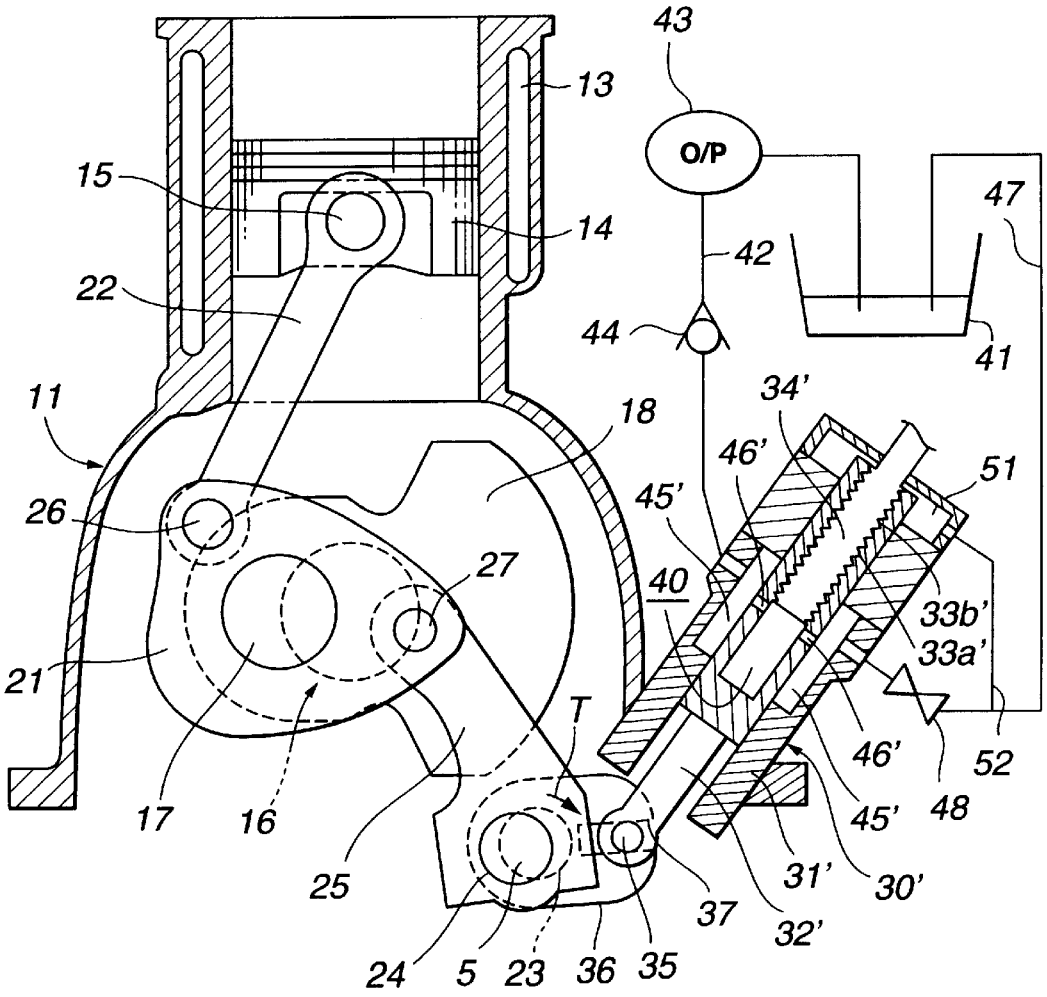
FIG. 12 is an assembled view showing a third embodiment of a multiple-link type variable compression ratio mechanism for a reciprocating engine.

FIG. 11 shows the cross section of the multiple-link type variable compression ratio mechanism of the second embodiment, whereas FIG. 12 shows the cross section of the multiple-link type variable compression ratio mechanism of the third embodiment. The variable compression ratio mechanism of each of the second and third embodiments is similar to the first embodiment of FIG. 1. Thus, the same reference signs used to designate elements in the mechanism of the first embodiment shown in FIG. 1 will be applied to the corresponding reference signs used in the mechanism of each of the second and third embodiments, for the purpose of comparison among the first, second, and third embodiments. Detailed description of the same elements will be omitted because the above description thereon seems to be self-explanatory.

The variable compression ratio mechanism of the second embodiment shown in FIG. 11 is different from that of the first embodiment shown in FIG. 1, in that a spring 50 is further provided and thus reciprocating block slider 32 is spring-biased. Exactly speaking, spring 50 is disposed between reciprocating-block-slider rear axial end face 32*a* and cap portion 34*a* in a properly compressed state, in a manner so as to bias reciprocating block slider 32 in the same direction as the direction that the reciprocating block slider is forced by way of the working-fluid pressure in hydraulic pressure chamber 40. Assuming that there is air in the hydraulic system of control-shaft actuator 30, in particular in the hydraulic pressure chamber, the pushing force applied to reciprocating block slider 32 by way of hydraulic pressure in pressure chamber 40 may be decreased. To compensate for lack of pushing force, spring 50 is very useful. By optimizing the pushing force applied to reciprocating block slider 32 by way of both spring bias and hydraulic pressure, it is possible to certainly prevent reversal of the direction of reciprocating load N acting on reciprocating block slider 32.

The structure of a control-shaft actuator 30' incorporated in the variable compression ratio mechanism of the third embodiment shown in FIG. 12 is different from the structure of actuator 30 incorporated in the mechanism of the first embodiment shown in FIG. 1, as described hereunder.

In actuator 30' of the third embodiment, a rotary member 34' is not cylindrical, and in lieu thereof the rear end portion of a reciprocating block slider 32' is formed as a substantially cylindrical portion. Rotary member 34' fixedly connected to the output shaft of the power source (motor) is substantially rod-shaped and has an external screw-threaded portion 33*a*' formed on the outer periphery thereof. On the other hand, an internal screw-threaded portion 33*b*' is formed on the inner periphery of the substantially cylindrical rear end portion of reciprocating block slider 32', such that internal screw-threaded portion 33*b*' is in meshed-engagement with external screw-threaded portion 33*a*'. Working fluid is supplied into the tooth space between the meshing pair of screw-threaded portions (33*a*', 33*b*') through a circumferential groove 45' formed in the inner periphery of a substantially cylindrical actuator casing 31' and a pair of radial through holes (46', 46') formed in the substantially cylindrical rear end portion of reciprocating block slider 32'. Then, a part of the working fluid supplied into the tooth space between the meshing pair of screw-threaded portions (33*a*', 33*b*') is returned via an auxiliary hydraulic pressure chamber 51 defined in the closed end of substantially cylindrical actuator casing 31' and an auxiliary working-fluid drain passage 52 communicating auxiliary hydraulic pressure chamber 51 into drain passage 47 downstream of hydraulic pressure regulating valve 48. Additionally, more of the working fluid supplied into the tooth space between the meshing pair of screw-threaded portions (33*a*', 33*b*') is delivered into the main hydraulic pressure chamber 40 defined by the inner peripheral wall surface of the substantially cylindrical rear end portion of reciprocating block slider 32' and the innermost axial end face of rod-shaped rotary member 34' formed with external screw-threaded portion 33*a*'. Working fluid drained from the main hydraulic pressure chamber 40 and working fluid drained from the auxiliary hydraulic pressure chamber 51 flow together at the downstream side of hydraulic pressure regulating valve 48, and returns to oil pan 41.

In actuator 30 of the first embodiment of FIG. 1, in order to smoothly rotate substantially cylindrical rotary member 34 (loosely fitted into the axial bore defined in actuator casing 31) about its axis, the rotary member has to be supported by means of bearings. In contrast, in actuator 30' of the third embodiment of FIG. 12, the substantially cylindrical rear end portion of reciprocating block slider 32' is loosely fitted into the axial bore defined in actuator casing 31'. The substantially cylindrical rear end portion of reciprocating block slider 32' is not rotated, but axially slid. This eliminates the necessity of bearings, and thus actuator 30' of the third embodiment is simple in construction. Additionally, rotary member 34' can be small-sized, because rotary member 34' is constructed as a rod-shaped male screw-threaded portion fixed to the output shaft of the power source (motor). This contributes to a reduction in the moment of inertia of the rotary member with respect to its axis, thus enhancing the response of switching between two different compression ratios.

The entire contents of Japanese Patent Application No. P2000-332254 (filed Oct. 31, 2000) is incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A variable compression ratio mechanism for a reciprocating internal combustion engine including a piston moveable through a stroke in the engine and having a piston pin and a crankshaft changing reciprocating motion of the piston into rotating motion and having a crankpin, the variable compression ratio mechanism comprising:

a plurality of links mechanically linking the piston pin to the crankpin;

a control shaft to which an eccentric cam is attached so that a center of the eccentric cam is eccentric to a center of the control shaft;

a control link connected at one end to one of the plurality of links and connected at the other end to the eccentric cam; and an actuator that drives the control shaft within a predetermined controlled angular range and holds the control shaft at a desired angular position so that a compression ratio of the engine continuously reduces by driving the control shaft in a first rotational direction and so that the compression ratio continuously increases by driving the control shaft in a second rotational direction opposite to the first rotational direction; the actuator comprising:

(i) a reciprocating block slider linked at a first end portion to the control shaft;

(ii) a rotary member being in meshed-engagement with a second end portion of the slider by a meshing pair of screw-threaded portions, so that rotary motion of the rotary member is converted into axial sliding motion of the slider to drive the control shaft in one of the first and second rotational directions; and (iii) a hydraulic pressure chamber facing an axial end face of the second end portion of the slider, so that working-fluid pressure in the hydraulic pressure chamber forces the slider in the same axial direction as a direction of action of a reciprocating load acting on the slider during down stroke of the piston, the reciprocating load acting on the slider in axial directions of the slider during up and down strokes of the piston.

2. The variable compression ratio mechanism as claimed in claim 1, wherein the hydraulic pressure chamber is provided so that the control shaft is rotated in a direction of a low compression ratio when the slider is forced in the same axial direction as the direction of action of the reciprocating load acting on the slider during down stroke of the piston.

3. The variable compression ratio mechanism as claimed in claim 1, wherein a check valve is disposed in a working-fluid supply passage that supplies working fluid into the hydraulic pressure chamber.

4. The variable compression ratio mechanism as claimed in claim 1, wherein a hydraulic pressure regulating valve is disposed in a working-fluid drain passage that drains the working fluid from the hydraulic pressure chamber, and the hydraulic pressure regulating valve is opened at least when the slider moves in a direction that a volume in the hydraulic pressure chamber decreases.

5. The variable compression ratio mechanism as claimed in claim 4, which further comprises a calculation section that calculates a predetermined engine speed below which there is no risk of reversing the direction of action of the reciprocating load, based on engine load and a phase angle of the control shaft, and the hydraulic pressure regulating valve is closed when engine speed is above the predetermined engine speed and additionally the volume in the hydraulic pressure chamber increases or remains unchanged.

6. The variable compression ratio mechanism as claimed in claim 1, wherein the working-fluid pressure in the hydraulic pressure chamber rises as the engine speed increases.

7. The variable compression ratio mechanism as claimed in claim 1, wherein an oil pump that pressurizes working fluid and supplies the pressurized working fluid into the hydraulic pressure chamber, is driven by way of rotation of the crankshaft.

8. The variable compression ratio mechanism as claimed in claim 1, wherein a pressure relief valve is disposed in a working-fluid drain passage that drains the working fluid from the hydraulic pressure chamber, in such a manner as to open when a predetermined pressure is reached.

9. The variable compression ratio mechanism as claimed in claim 1, wherein the rotary member is substantially cylindrical in shape, and the meshing pair of screw-threaded portions comprises:

(i) an external screw-threaded portion formed on an outer periphery of the second end portion of the slider; and (ii) an internal screw-threaded portion formed on an inner periphery of the substantially cylindrical rotary member, so that the internal and external screw-threaded portions are in meshed-engagement with each other.

10. The variable compression ratio mechanism as claimed in claim 1, wherein the rotary member is substantially rod-shaped, and the second end portion of the slider is substantially cylindrical in shape, and the meshing pair of screw-threaded portions comprises:

(i) an external screw-threaded portion formed on an outer periphery of the substantially rod-shaped rotary member; and (ii) an internal screw-threaded portion formed on an inner periphery of the substantially cylindrical rear end portion of the slider, so that the internal and external screw-threaded portions are in meshed-engagement with each other.

11. The variable compression ratio mechanism as claimed in claim 1, which further comprises a spring that permanently biases the slider in the same axial direction as the direction of action of the reciprocating load acting on the slider during down stroke of the piston.

12. A variable compression ratio mechanism for a reciprocating internal combustion engine including a piston moveable through a stroke in the engine and having a piston pin and a crankshaft changing reciprocating motion of the piston into rotating motion and having a crankpin, the variable compression ratio mechanism comprising:

a plurality of links mechanically linking the piston pin to the crankpin;

a control shaft to which an eccentric cam is attached so that a center of the eccentric cam is eccentric to a center of the control shaft;

a control link connected at one end to one of the plurality of links and connected at the other end to the eccentric cam; and a control-shaft actuating means for driving the control shaft within a predetermined controlled angular range and holds the control shaft at a desired angular position so that a compression ratio of the engine continuously reduces by driving the control shaft in a first rotational direction and so that the compression ratio continuously increases by driving the control shaft in a second rotational direction opposite to the first rotational direction; the actuating means comprising:

(i) a reciprocating block slider linked at a first end portion to the control shaft;

(ii) a rotary member being in meshed-engagement with a second end portion of the slider by a meshing pair of screw-threaded portions, so that rotary motion of the rotary member is converted into axial sliding motion of the slider to drive the control shaft in one of the first and second rotational directions; and (iii) a substantially cylindrical casing cooperating with the slider and the rotary member to define a hydraulic pressure chamber facing an axial end face of the second end portion of the slider so that working-fluid pressure in the hydraulic pressure chamber forces the slider in the same axial direction as a direction of action of a reciprocating load acting on the slider during down stroke of the piston, the reciprocating load acting on the slider in axial directions of the slider during up and down strokes of the piston.

13. The variable compression ratio mechanism as claimed in claim 12, which further comprises a spring means for permanently biasing the slider in the same axial direction as the direction of action of the reciprocating load acting on the slider during down stroke of the piston.

14. The variable compression ratio mechanism as claimed in claim 12, wherein a hydraulic pressure regulating valve means is disposed in a working-fluid drain passage that drains the working fluid from the hydraulic pressure chamber, and the hydraulic pressure regulating valve means is opened at least when the slider moves in a direction that a volume in the hydraulic pressure chamber decreases.

15. The variable compression ratio mechanism as claimed in claim 14, which further comprises a calculation means for calculating a predetermined engine speed below which there is no risk of reversing the direction of action of the reciprocating load, based on engine load and a phase angle of the control shaft, and the hydraulic pressure regulating valve means is closed when engine speed is above the predetermined engine speed and additionally the volume in the hydraulic pressure chamber increases or remains unchanged.

16. The variable compression ratio mechanism as claimed in claim 14, which further comprises:

(i) an estimation means for estimating, based on engine operating conditions, a waveform of input torque acting on the control shaft;

(ii) a comparing means for determining, based on the waveform estimated, whether the input torque acting in the second rotational direction opposite to the first rotational direction exists, and wherein:

when the input torque acting in the second rotational direction does not exist, the hydraulic pressure regulating means is opened irrespective of whether the variable compression ratio mechanism is operated in a low-to-high compression ratio changing mode wherein the compression ratio is changed from low to high, in a high-to-low compression ratio changing mode wherein the compression ratio is changed from high to low, or in a hold compression ratio mode wherein the compression ratio is held constant.

17. The variable compression ratio mechanism as claimed in claim 16, wherein the hydraulic pressure regulating means is opened when the variable compression ratio mechanism is operated in the low-to-high compression ratio changing mode and the input torque acting in the second rotational direction exists.

18. The variable compression ratio mechanism as claimed in claim 17, wherein the hydraulic pressure regulating means is closed when the variable compression ratio mechanism is operated in the high-to-low compression ratio changing mode or in the hold compression ratio mode and additionally the input torque acting in the second rotational direction exists.

* * * * *